US005320047A

United States Patent [19]

Deurloo et al.

[11] Patent Number: 5,320,047

[45] Date of Patent: Jun. 14, 1994

[54] DESK HAVING SELF-RELEVELING HEIGHT ADJUSTMENT AND HYDRAULIC CIRCUIT THEREFOR

[75] Inventors: John M. Deurloo, Grand Rapids; Roger L. Betten, Wyoming, both of Mich.

[73] Assignee: Monarch Hydraulics, Inc., Grand Rapids, Mich.

[21] Appl. No.: 846,813

[22] Filed: Mar. 6, 1992

[51] Int. Cl.[5] ..... A47B 9/00

[52] U.S. Cl. ..... 108/20; 108/147; 280/6.12; 60/579; 91/515

[58] Field of Search ..... 108/144, 147, 20; 254/45; 280/6.12, 840; 91/515; 60/579

[56] References Cited

U.S. PATENT DOCUMENTS

| | | | |
|---|---|---|---|
| 2,532,342 | 12/1950 | Sloane . | |
| 2,838,844 | 6/1958 | Sackett . | |
| 2,872,200 | 2/1959 | Kroll . | |
| 3,035,853 | 5/1962 | Klein | 280/6.12 |
| 3,080,835 | 3/1963 | Guglielmi . | |
| 3,269,685 | 8/1966 | Wallace . | |
| 3,578,278 | 5/1971 | Pickering et al. . | |
| 3,595,180 | 7/1971 | Swoyer | 108/144 |
| 3,731,470 | 5/1973 | Cornish et al. . | |
| 3,853,075 | 12/1974 | Burch . | |
| 3,953,040 | 4/1976 | Unruh et al. . | |
| 4,157,066 | 6/1979 | Pretty | 91/171 |
| 4,164,122 | 8/1979 | Ward | 91/171 |
| 4,248,260 | 2/1981 | Addison et al. | 91/171 |
| 4,337,959 | 7/1982 | Bettin et al. | 91/515 |
| 4,350,354 | 9/1982 | Dotti et al. | 280/6.12 |
| 4,354,688 | 10/1982 | Swanson | 280/43.23 |
| 4,374,497 | 2/1983 | Harmand . | |
| 4,381,714 | 5/1983 | Henneberg et al. . | |
| 4,477,045 | 10/1984 | Karasawa et al. . | |
| 4,535,788 | 8/1985 | Rowland-Hill et al. . | |
| 4,548,214 | 10/1985 | Sheehan et al. . | |
| 4,557,276 | 12/1985 | Hyman et al. . | |
| 4,756,496 | 7/1988 | Hosan et al. | 108/144 |
| 5,072,649 | 12/1991 | Laghi . | |
| 5,174,223 | 12/1992 | Nagy et al. | 108/144 X |

FOREIGN PATENT DOCUMENTS

| | | | |
|---|---|---|---|
| 3205661 | 8/1983 | Fed. Rep. of Germany | 60/579 |
| 2380218 | 9/1978 | France . | |
| 9218033 | 10/1992 | PCT Int'l App. . | |

OTHER PUBLICATIONS

"Series Cylinder Systems", p. 12, Prince Manufacturing Corporation, date unknown.

"Cessna Model 51000 Wyr-Loc Cylinders", pp. 1-3, Fluid Power Division, Cessna Aircraft Company, 1984.

*Primary Examiner*—Michael Milano

*Attorney, Agent, or Firm*—Warner, Norcross & Judd

[57] ABSTRACT

A self-releveling, height adjustable, hydraulically operated desk and a hydraulic circuit therefor are disclosed in which the desk top is supported for vertical movement upon master and slave rephasing cylinders connected in series. The desk top may be releveled by extending the cylinders to their limits of extension. The desk and circuit may include a height adjustable monitor support. The monitor support may also be supported for vertical movement upon master and slave rephasing cylinders for self-releveling. The hydraulic circuit includes check valves to prevent the desk top and the monitor support from being raised with respect to the supporting structure except upon activation of the hydraulic pump.

14 Claims, 2 Drawing Sheets

DESK HAVING SELF-RELEVELING HEIGHT ADJUSTMENT AND HYDRAULIC CIRCUIT THEREFOR

BACKGROUND OF THE INVENTION

1. Field of the Invention

The present invention relates to a desk or work surface and, more particularly, to a hydraulically operated height adjustable desk having a means for self-releveling the desk top.

2. Description of the Related Art

Providers of office furniture have been increasingly aware of the need for proper ergonomic design. It is desirable that items of furniture be conformed to maximize the safety, comfort, and effectiveness of workers. With desks, it is highly desirable that the height of the desk top be adjustable to accommodate workers of various heights and to allow workers to alter their posture from time to time. Accordingly, desks are known in which the desk top is mounted atop a gas spring cylinder. The cylinder is released by the worker to adjust the desk top up and down.

Larger and heavier desk tops require stronger and more complex mechanisms to support the weight of the desk and to maintain the levelness of the desk top. Various approaches to such mechanisms include the use of multiple cylinders, or arrangements of springs, wires and pulleys. Whatever approach is used, several factors will tend, over time, to cause the mechanism to allow the desk top to deviate from level. Such factors include normal wearing of the mechanism components and uneven loading on the desk top surface. In a desk provided with a hydraulic lift system, hydraulic fluid may leak or seep past valves and seals, resulting in a nonlevel desk top.

Since it is likely that a height adjustable desk may periodically deviate from level, it is desirable that the mechanism be provided with a means for releveling the desk top. Preferably, the releveling means should be readily accessible and easy to operate. Most desirably, the desk top should be self releveling.

With the current widespread use of computers, it is also desirable for a desk or worksurface to include a height adjustable support for a computer monitor.

Accordingly, there is a heretofore unmet need for a reliable and effective self-releveling height adjustable desk having a computer monitor support.

SUMMARY OF THE INVENTION

The present invention satisfies the aforementioned need by providing a self-releveling hydraulic circuit for height adjustable support of a desk top or other work surface. The desk is releveled by activating a hydraulic pump until the desk top rises to the upper limit of its range of vertical movement. The desk top is kept in this position momentarily then is lowered to its desired position. In additional aspect, the invention provides a hydraulic circuit for self-releveling height adjustment of a computer monitor support associated with the desk top.

According to the principles of the invention, the desk top is supported for vertical movement by at least two hydraulic cylinders connected in series. The first cylinder is a master cylinder and the second a slave. The cylinders are of the type known as rephasing cylinders having bypass arrangements in which fluid may pass through the cylinder when the piston has reached the limit of its extension movement. The master cylinder is divided by a piston into first and second expansible chambers. A supply of hydraulic fluid is communicated to the first, or lower, chamber of the master cylinder. A fluid port is formed in the cylinder disposed in communication with the second, or upper, chamber of the master cylinder in relation to the normal operating range of the piston within the cylinder. The fluid port of the master cylinder is in communication with the slave cylinder. The cylinders are dimensioned such that the cross-sectional annular area of the upper chamber of the master cylinder is substantially equal to the cross-sectional area of the slave cylinder chamber. In this manner, the second chamber of the master cylinder and the first chamber of the slave cylinder together form a fluid-filled space of substantially constant volume.

To raise the desk top, fluid is pumped into the lower chamber of the master cylinder. The piston of the master cylinder is forced upward, thus forcing fluid out of the upper chamber through the port. Fluid exiting the upper chamber enters the lower chamber of the slave cylinder. The piston of the slave cylinder, dimensioned as described above, is forced upward at the same rate as the piston of the master cylinder. The desk top is thus raised by the rods of the cylinders.

To lower the desk top, hydraulic fluid in the master cylinder lower chamber is released, and the weight of the desk top forces the pistons of both cylinders to move downward, transferring fluid in the slave cylinder back to the master cylinder upper chamber.

Self-releveling of the desk top is accomplished by continuing to supply fluid to the lower chamber of the master cylinder until the desk top is raised to the upper limit of its range of movement. In this position, the pistons of the master and slave cylinders are raised to enable hydraulic fluid to flow through the cylinder bypasses. If the desk is initially out of level, the bypass of one cylinder will be active before the other, allowing the piston of the other cylinder to continue to rise until both bypasses are active and the desk top or other work surface is level and the cylinders are in phase.

After being releveled in the manner described above, the desk top may then be lowered to its desired height.

According to other features of the invention, the hydraulic circuit includes a branch for height-adjustable support of a computer monitor in association with the desk. The monitor is supported by hydraulic cylinders which may also be of the rephasing type for self-releveling of the monitor support.

These and other objects, advantages, and features of the present invention will he more fully understood and appreciated by reference to the written specification and appended drawings.

DESCRIPTION OF THE PREFERRED EMBODIMENT

Figure 1:
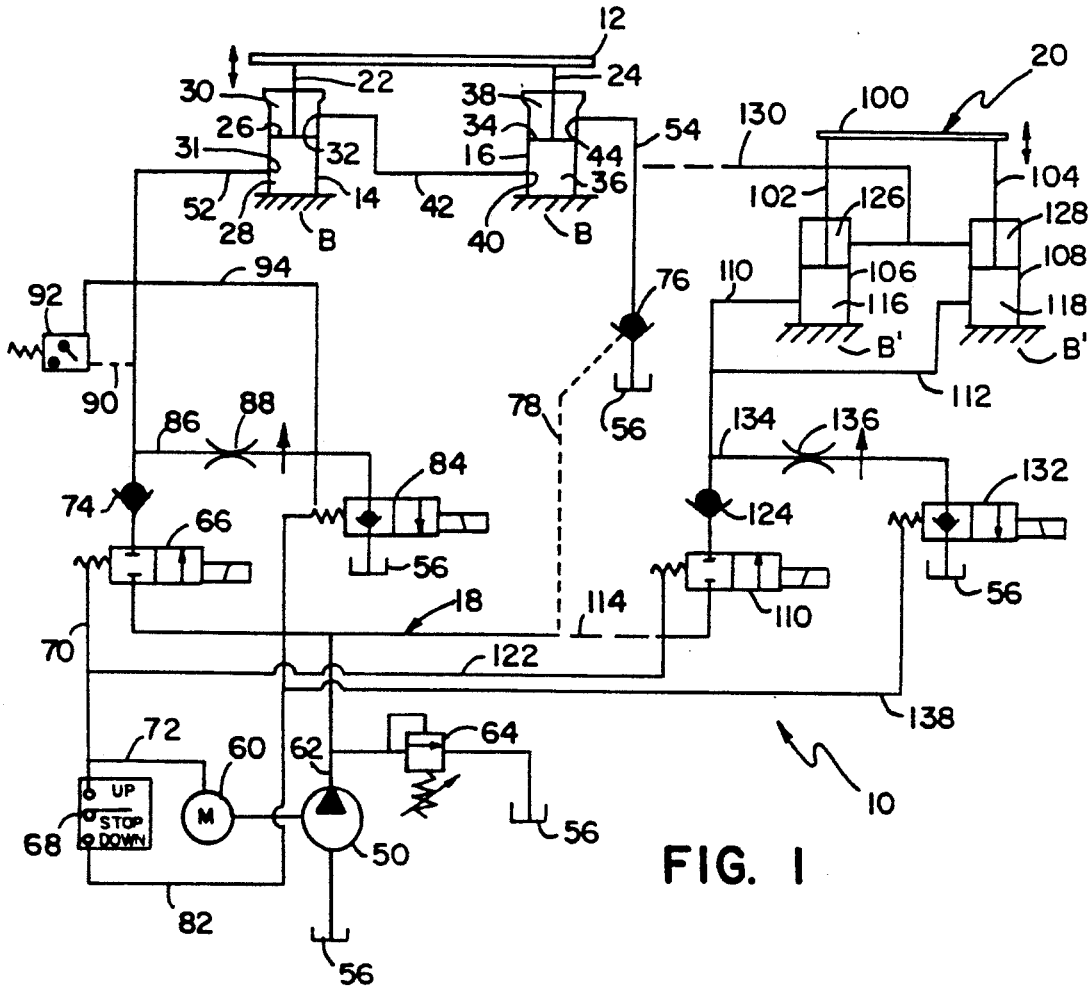
FIG. 1 is a schematic diagram of a hydraulic circuit for height adjustable, self-releveling support of a desk top and a computer monitor support according to the principles of the invention.

By way of disclosing a preferred embodiment, and not by way of limitation, there is shown in FIG. 1 a hydraulic circuit 10 used for the height adjustable, self-releveling support of a desk top 12. It should be understood that the terms "desk" and "desk top" as used in this specification and the appended claims are intended to encompass other furniture work surfaces such as tables and table tops.

The hydraulic circuit 10 includes in its general organization a first, or master cylinder 14 and a second, or slave cylinder 16 upon which the desk top is supported, and a hydraulic system 18 adapted for causing the master and slave hydraulic cylinders to raise the desk top and allowing the desk top to lower. At the right of FIG. 1 there is shown an optional auxiliary support 20 suitable for use as a computer monitor support to be described more fully below.

The desk top 12 is a generally flat work surface which will usually be horizontal but may also be tilted. The master cylinder 14 and slave cylinder 16 each have a telescoping rod 22, 24. The desk top is mounted to the upper ends of the telescoping rods. The master and slave cylinders are supported by any base B, such as by resting them upon the floor, upon legs or pedestals, or by mounting the cylinders to a lower desk structure.

Master cylinder 14 contains piston 26 which divides the interior of the cylinder into a first, or lower, expansible chamber 28 and a second, or upper, expansible chamber 30. Both chambers are filled with hydraulic fluid. A first, or lower port 31 is formed through the lower portion of the master cylinder wall in fluid communication with the lower chamber 28. A second, or upper port 32 is formed through the upper portion of the master cylinder wall such that when the piston 26 is disposed in its normal adjustment range within the cylinder, as shown in FIG. 1, the port 32 is in fluid communication with Lhe upper chamber 30.

Slave cylinder 16 is also sealed at both ends and contains piston 34 which divides the interior of the cylinder into a first, or lower, expansible chamber 36 and a second, or upper, expansible chamber 38. Both chambers are filled with hydraulic fluid. A first, or lower port 40 is formed through the lower portion of the slave cylinder wall in fluid communication with the lower chamber 36. Port 40 is interconnected to port 32 of the master cylinder by hydraulic tube 42. Thus, master cylinder 14 is connected in series with slave cylinder 16. A second, or upper port 44 is formed through the upper portion of the slave cylinder wall such that when the piston 34 is disposed within its normal adjustment range, as shown in FIG. 1, the port 44 is in fluid communication with the upper chamber 38.

Master cylinder 14 and slave cylinder 16 are of the type known as "rephasing" cylinders. As is known in the hydraulic art, a rephasing cylinder is configured such that when the piston reaches the limit of its extension movement, hydraulic fluid will be allowed to flow through the cylinder. Master cylinder 14 is advantageously configured such that, when piston 26 reaches the upper limit of its movement, lower chamber 28 will be in direct fluid communication with upper port 32, thus allowing hydraulic fluid to pass through the cylinder even though the piston can no longer rise. Similarly, slave cylinder 15 is configured such that, when piston 34 reaches the upper limit of its movement, lower chamber 36 will be in direct fluid communication with upper port 44. Suitable rephasing cylinders are available from Prince Manufacturing Corporation of Sioux City, Iowa, as well as from other manufactures.

Cylinders 14 and 16 are mounted to the desk top 12 and to the supporting structure B such that when the cylinder pistons are at their upper limit of movement, the desk top will be level.

In the adjustment mode, as shown in FIG. 1, the desk is raised by activating pump 50 to force hydraulic fluid through tube 52 and port 31 into the lower chamber 28 of master cylinder 14. The piston 26 is pushed upward as is the portion of the desk top 12 supported by rod 22. As the piston 26 rises, hydraulic fluid is forced out of the master cylinder upper chamber 30 through port 32, tube 42, and port 40 into the lower chamber 36 of the slave cylinder. The slave cylinder piston 34 is caused to rise simultaneously with the master cylinder piston. Fluid in the slave cylinder upper chamber 38 is forced out through upper port 44 and tube 54 to fluid reservoir 56.

To lower the desk top 12, fluid is allowed to exit the master cylinder lower chamber 28 through port 31. The force of gravity acting on the desk top through the rods 22, 24 forces the pistons 26 and 34 downward, transferring fluid from the slave cylinder lower chamber 36 back into the master cylinder upper chamber 30. Fluid is drawn from the reservoir 56 back into the slave cylinder upper chamber 38.

Figure 2:
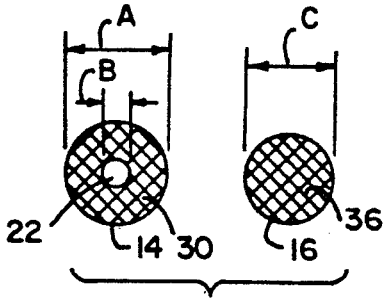
FIG. 2 is a diagrammatic sectional view taken through the master and slave cylinders which support the desk top.

The pistons of both the master cylinder and the slave cylinder must travel at the same rate in order to maintain the desk top level as it is adjusted up and down. As shown in FIG. 2, this result is obtained by proper dimensioning of the cylinders. The crosshatched annular transverse area of the upper chamber 30 of the master cylinder 14 is substantially equal to the transverse area of the lower chamber 36 of the slave cylinder 16. The following table lists suitable, convenient values for the master cylinder inner diameter A, the master cylinder rod diameter B, and the slave cylinder inner diameter C (all dimensions in inches):

| A | B | C |
|---|---|---|
| 7/8 | 7/8 | 1/2 |
| 15/16 | 9/16 | 3/4 |
| 1 1/4 | 3/4 | 1 |
| 1 1/16 | 1/2 | 15/16 |
| 1 5/16 | 9/16 | 1 3/16 |
| 1 7/8 | 1 1/8 | 1 1/2 |
| 2 1/2 | 1 1/2 | 2 |

In order to relevel the desk top or, in other words, to rephase the master cylinder and the slave cylinder, pump 50 is activated to pump hydraulic fluid into the master cylinder lower chamber 28 until the master cylinder piston and the slave cylinder both rise to their upper limits of movement to bring port 32 into fluid communication with chamber 28, and port 44 into fluid communication with chamber 36. In this position, the pump, lower chambers, and fluid reservoir are interconnected such that any additional fluid pumped into the master cylinder will pass through the lower chambers of both cylinders into reservoir 56. If one side of the desk top is lower than the other, the low side may continue to rise after the other side is at its upper limit.

The remainder of the hydraulic componentry shown in FIG. 1 includes an electric motor 60 for driving external gear hydraulic pump 50. Fluid tube 62 is connected to adjustable relief valve 64 which allows fluid to pass through to reservoir 56 in the event of fluid pressure overload. Reservoir 56 is preferably constructed to be fluid tight but to allow for circuit expansion and contraction such as through the use of an internal bladder, diaphragm, or breather.

Tube 62 leads to two-way, two-position, normally closed, spring offset, solenoid operated valve 66. A three position electrical switch 68 has positions for desk up, desk down, and desk stop. In the up position, switch 68, by suitable electrical connections 70, 72 activates motor 60 and opens valve 66. Fluid is then pumped from the reservoir through valve 66, check valve 74, and tube 52 into the lower chamber of the master cylinder 14 as described above. Fluid exiting the upper chamber of slave cylinder 44 passes through tube 54 and pilot operated check valve 76 into reservoir 56. Pilot operated check valve 76 is connected to tube 62 by pilot tube 78 such that the increased fluid pressure caused by pump 50 causes check valve 76 to open.

To relevel the desk, the switch 68 is held in the up position until the desk reaches the top of its range of movement and for a moment thereafter.

To stop and maintain the desk top at the desired height, switch 68 is placed in the stop position. Valve 66 and pilot operated check valve 76 are both closed. With this arrangement, if the desk top is lifted, the desk supports will not fall to the floor, since pilot operated check valve 76 prevents fluid from being drawn from the reservoir into the upper chamber 38 of the slave cylinder. Thus, in the stop position the desk legs are locked in position.

To lower the desk, the switch 68 is moved to the down position. Electrical connection 82 causes two-way, two-position, normally closed, spring offset, solenoid operated valve 84 to open. This allows the weight of the desk top to force fluid from the cylinders 14 and 16 out through tubes 52 and 86 to reservoir 56. Fluid is drawn from the reservoir through check valve 76 into the upper chamber of the slave cylinder 16. Tube 86 is fitted with a pressure-compensated flow control orifice 88 which regulates the rate of descent of the desk top.

Tube 52 is connected by pilot tube 90 to pressure switch 92. If the desk top is overloaded, fluid pressure will trip switch 92. Switch 92 will then, by electrical connection 94, cause valve 84 to open, thus allowing the desk top to descend at a regulated rate until the overload is removed or the desk top reaches bottom.

According to an additional feature of the invention, an auxiliary support 20 may be provided, as shown in FIG. 1. The auxiliary support 20 is particularly useful for supporting a computer monitor. The hydraulic circuitry of the auxiliary support is arranged so that the support surface 100 rises and falls in conjunction with the desk top 12.

The auxiliary support surface 100 is supported by the rods 102, 104 of a pair of hydraulic cylinders 106, 108. The cylinders are supported upon a suitable base B' such as the floor, legs, a pedestal, or the base of the desk. The cylinders 106, 108 are connected in parallel by fluid tubes 110, 112, 114 to fluid tube 62 which forces hydraulic fluid in to the chambers 116, 118 of the cylinders 106, 108 when switch 68 is placed in the up position. Two way, two position, normally closed, spring offset, solenoid operated valve 110 is opened by electrical connection 122 when the auxiliary support is raised. Check valve 124 is disposed in tube 114. The upper chambers 126, 128 of the cylinders 106, 108 are also filled with fluid and are connected by fluid tube 130 to fluid tube 54. Upon lifting of the support surface 100, fluid in the upper chambers 126, 128 flows through fluid tubes 130 and 54 to reservoir 56.

Fluid tube 114 is connected to fluid tube 134 which leads through pressure compensated orifice 136 and two way, two position, normally closed, spring offset, solenoid operated valve 132 to reservoir 56. When the switch 68 is placed in the down position, electrical connection 138 causes valve 132 to open, allowing the support surface 100 to descend along with the desk top 12 at a uniform rate. Thus, switch 68 controls the simultaneous raising and lowering of both the desk top 12 and the auxiliary support surface 20.

Figure 3:
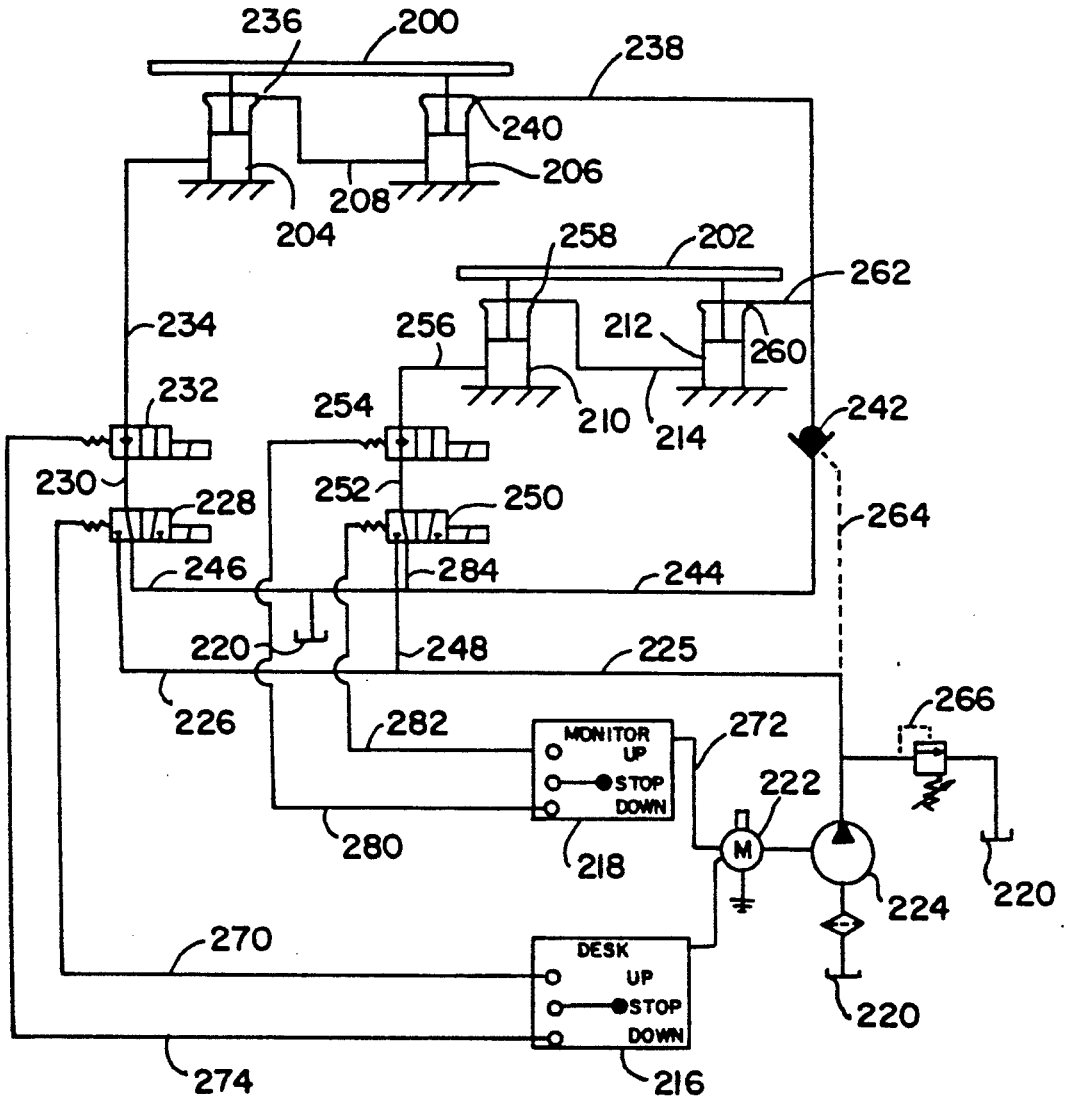
FIG. 3 is a schematic diagram of an alternate embodiment of the hydraulic circuit according to the principles of the invention.

An alternate embodiment of the invention is shown in FIG. 3. In this embodiment, a desk, or similar piece of work surface furniture, includes a desk top 200 and a computer monitor support 202 both of which are independently, hydraulically height adjustable and self-releveling. Desk top 200 and monitor support 202 are advantageously both incorporated in the same piece of furniture and supported by the same substructure. For example, desk top 200 may have a cut out area in which is disposed the monitor support 202.

Desk top 200 is supported atop the rods of master cylinder 204 and slave cylinder 206. Cylinders 204 and 206 are rephasing cylinders as described above with respect to FIG. 1. The upper chamber of master cylinder 204 is interconnected with the lower chamber of slave cylinder 206 by fluid tube 208. Monitor support 202 is similarly supported by the rods of rephasing master cylinder 210 and rephasing slave cylinder 212. The upper chamber of master cylinder 210 is interconnected with the lower chamber of slave cylinder 212 by fluid tube 214.

The hydraulic and electrical circuitry of FIG. 3 is arranged such that the desk top 200 and monitor support 202 may be selectively and independently raised, lowered, and releveled. The raising and lowering of the desk top 200 is controlled by three position electrical switch 216. The raising and lowering of the monitor support 202 is controlled by the three position electrical switch 218.

Hydraulic fluid is applied from reservoir 220. Electric motor 222 operates pump 224. The output of pump 224 is connected by fluid tubes 225 and 226 to three way, two position, spring offset solenoid valve 228. Valve 228 is connected in series by fluid tube 230 to two way, two position, normally closed, spring offset solenoid valve 232. Valve 232 is in turn connected by fluid tube 234 to the lower chamber of master cylinder 204. Fluid tube 208 interconnects by bypass port 236 of master cylinder 204 with the lower chamber of slave cylinder 206. Fluid tube 238 leads from the bypass port 240 of slave cylinder 206 to pilot operated check valve 242. Fluid tube 244 interconnects valve 242 with the reservoir 220. Fluid tube 246 interconnects valve 228 with reservoir 220.

The output of pump 224 is further connected via fluid tubes 225 and 248 to three way, two position, spring offset solenoid valve 250. Valve 250 is connected by fluid tube 252 to two way, two position, normally closed, spring offset solenoid valve 254. Fluid tube 256 leads from valve 254 to the lower chamber of master cylinder 210. The bypass port 258 is interconnected with the lower chamber of slave cylinder 212 by tube 214. The bypass port 260 of slave cylinder 212 is connected by fluid tube 262 with tube 238.

Pilot operated check valve 242 is connected to tube 225 by pilot tube 264 such that increased fluid pressure caused by the operation of pump 224 causes valve 242 to open. Tube 225 is further connected to adjustable relief valve 266 which allows fluid to pass through to reservoir 220 in the event of fluid pressure overload.

The solenoid valves 228, 232, 250, 254 are shown in FIG. 3 in their normal, or deactivated, positions in which movement of the desk top 200 and monitor support 202 is stopped.

Switch 216 has three positions corresponding to desk top up, desk top stop, and desk top down. To raise the desk top, switch 216 is moved to the up position. With switch 216 in the up position, the solenoid of valve 228 is activated by a suitable electric connection 270, thus bringing fluid tube 226 into communication with fluid tube 230. At the same time, motor M is activated by electric connection 272 to operate pump 224 and open check valve 242. Fluid is pumped from reservoir 220 through tubes 225 and 226, valves 228 and 232, tube 234, and into the lower chamber of master cylinder 204. As the piston of cylinder 204 rises, fluid in the upper chamber passes through tube 208 to the lower chamber of cylinder 206, thus lifting the desk top evenly. Fluid in the upper chamber of slave cylinder 206 passes through tube 238, valve 242, tube 244, and into reservoir 220. Returning switch 216 to the stop position returns valve 228 to the deactivated position, stops the pump, and ceases movement of the desk top.

To lower the desk top, switch 216 is moved to the down position. The solenoid of valve 232 is activated by electrical connection 274 to bring tube 234 into fluid communication with tubes 230 and 246. The weight of desk top 200 causes fluid to be forced from the lower chambers of master and slave cylinders 204, 206. Fluid exiting the lower chamber of the master cylinder 204 passes through tube 234, valve 232, tube 230, valve 228, tube 246, and into reservoir 220. Returning switch 216 to the stop position returns valve 232 to the deactivated position, stops the pump, and ceases movement of the desk top.

Switch 218 has three positions corresponding to monitor support up, monitor support stop, and monitor support down. To raise the monitor support switch 218 is moved to the up position. With switch 218 in the up position, the solenoid of valve 250 is activated by a suitable electric connection 280, thus bringing fluid tube 248 into communication with fluid tube 252. At the same time, motor M is activated by electric connection 272 to operate pump 224 and open check valve 242. Fluid is pumped from reservoir 220 through tubes 225 and 248, valves 250 and 254, tube 256, and into the lower chamber of master cylinder 210. As the piston of cylinder 210 rises, fluid in the upper chamber passes through tube 214 to the lower chamber of cylinder 212, thus lifting the monitor support evenly. Fluid in the upper chamber of slave cylinder 212 passes through tube 262, valve 242, tube 244, and into reservoir 220. Returning switch 218 to the stop position returns valve 250 to the deactivated position, stops the pump, and ceases movement of the monitor support.

To lower the monitor support, switch 218 is moved to the down position. The solenoid of valve 254 is activated by electrical connection 282 to bring tube 256 into fluid communication with tubes 252 and 244. The weight of monitor support 202 and a monitor supported thereon causes fluid to be forced from the lower chambers of master and slave cylinders 210, 212. Fluid exiting the lower chamber of the master cylinder 210 passes through tube 256, valve 254, tube 252, tube 284, and into reservoir 220. Returning switch 218 to the stop position returns valve 254 to the deactivated position, stops the pump, and ceases movement of the monitor support.

When switches 216 or 218 are in the stop position, the desk top 200 and monitor support 202, respectively, are locked in position relative to the supporting structure. If lifting force is applied to the desk top 200, valve 242 prevents fluid from exiting slave cylinder 206. Similarly, if lifting force is applied to the monitor support 202, valve 242 prevents fluid from exiting slave cylinder 212.

Other configurations of the switches are possible with the scope of the invention. For example, four individual switches may be used, the first for raising the desk top, the second for lowering the desk top, the third for raising the monitor support, the fourth for lowering the monitor support.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A hydraulic circuit for the height adjustment and releveling of a desk top comprising:

a first master rephasing cylinder;

a first slave rephasing cylinder;

said first master rephasing cylinder and said first slave rephasing cylinder each having a bypass port whereby fluid may pass through the cylinder when the cylinder is fully extended;

said first master rephasing cylinder and said first slave rephasing cylinder being adapted to support and carry a desk top for vertical movement;

a fluid reservoir;

a supply of fluid;

a pump for pumping fluid;

fluid passageway means interconnecting said pump, said reservoir, said first master rephasing cylinder, and said first slave rephasing cylinder, said first slave rephasing cylinder being connected in series with said first master rephasing cylinder;

first valve means in said fluid passageway means being activatable to direct pumped fluid into said first master rephasing cylinder, thereby causing said first master rephasing cylinder and said first slave rephasing cylinder to extend and raise said desk top;

second valve means in said fluid passageway means being activatable to allow fluid in said first master rephasing cylinder and said first slave rephasing cylinder to return to said reservoir, thereby causing said first master rephasing cylinder and said first slave rephasing cylinder to retract and lower said desk top; and switch means having a first position for activating said pump and said first valve means whereby said desk top is raised, a second position for activating said second valve means whereby said desk top is lowered, and a third position whereby said desk top is stopped;

whereby said desk top may be releveled by placing said switch means in its first position and raising said desk top until said first master cylinder and said first sleeve cylinder are fully extended.

2. The hydraulic circuit of claim 1 further comprising check valve means in said fluid passageway means for preventing fluid from flowing to or from said first master rephasing cylinder and said first slave rephasing cylinder when said switch means is in its third position.

3. The hydraulic circuit of claim 1 further comprising a fluid flow control means in said fluid passage way means for regulating the rate of lowering of said desk top when said switch means is in its second position.

4. The hydraulic circuit of claim 1 further comprising a fluid flow check means for preventing the flow of fluid into said second chamber of said second cylinder except when lowering of the desk to is desired.

5. The hydraulic circuit of claim 1 further comprising fluid pressure sensing means for allowing the desk top to lower upon sensing excess fluid pressure.

6. The hydraulic circuit of claim 1 further comprising:

a second master rephasing cylinder;

a second slave rephasing cylinder;

said second master rephasing cylinder and said second slave rephasing cylinder each having a bypass port whereby fluid may pass through the cylinder when the cylinder is fully extended;

said second master rephasing cylinder and said second slave cylinder being adapted to support and carry a monitor support for vertical movement;

said fluid passageway means further interconnecting said pump, said reservoir, said second master rephasing cylinder, and said second slave rephasing cylinder, said second slave rephasing cylinder being connected in series with said second master rephasing cylinder;

third valve means in said fluid passageway means being activatable to direct pumped fluid into said second master rephasing cylinder, thereby causing said second master rephasing cylinder and said second slave rephasing cylinder to extend and raise said monitor support;

fourth valve means in said fluid passage way means being activatable to allow fluid in said second master rephasing cylinder and said second slave rephasing cylinder to return to said reservoir, thereby causing said second master rephasing cylinder and said second slave rephasing cylinder to retract and lower said monitor support;

said switch means further having a fourth position for activating said pump and said third valve means whereby said monitor support is raised, a fifth position for activating said fourth valve means whereby said monitor support is lowered, and a sixth position whereby said monitor support is stopped;

whereby said monitor support may be releveled by placing said switch means in its fourth position and raising said monitor support until said second master cylinder and said second slave cylinder are fully extended.

7. The hydraulic circuit of claim 1 further comprising a third cylinder and a fourth cylinder adapted to support and carry a monitor support for vertical movement, said fluid passageway means further interconnecting said third cylinder and said fourth cylinder, a third valve means activatable to direct pumped fluid into said third and fourth cylinders whereby said monitor support is raised, and a fourth valve means activatable to allow fluid to exit said third and fourth cylinders whereby said monitor support is lowered.

8. A desk comprising:

a supporting structure;

a height adjustable desk top;

a height adjustable monitor support; and a hydraulic circuit comprising;

a first master rephasing cylinder;

a first slave rephasing cylinder;

a second master rephasing cylinder;

a second slave rephasing cylinder;

each of said cylinders having a bypass port whereby fluid may pass through the cylinder when the cylinder is fully extended;

said first master rephasing cylinder and said first slave rephasing cylinder supporting and carrying said desk top for vertical movement with respect to said supporting structure;

said second master rephasing cylinder and said second slave rephasing cylinder supporting and carrying said monitor support for vertical movement with respect to said supporting structure;

a fluid reservoir;

a supply of fluid;

a pump for pumping fluid;

fluid passageway means interconnecting said pump, said reservoir, said first master rephasing cylinder, said first slave rephasing cylinder, said second master rephasing cylinder, said second slave rephasing cylinder, said first slave rephasing cylinder being connected in series with said first master rephasing cylinder, said second slave rephasing cylinder being connected in series with said second master rephasing cylinder;

first valve means in said fluid passageway means being activatable to direct pumped fluid into said first master rephasing cylinder, thereby causing said first master rephasing cylinder and said first slave rephasing cylinder to extend and raise said desk top;

second valve means in said fluid passageway means being activatable to allow fluid in said fast master rephasing cylinder and said first slave rephasing cylinder to return to said reservoir, thereby causing said first master rephasing cylinder and said first slave rephasing cylinder to retract and lower said desk top;

third valve means in said fluid passageway means being activatable to direct pumped fluid into said second master rephasing cylinder, thereby causing said second master rephasing cylinder and said second slave rephasing cylinder to extend and raise said monitor support;

fourth valve means in said fluid passageway means being activatable to allow fluid in said second master rephasing cylinder and said second slave rephasing cylinder to return to said reservoir, threreby causing said second master rephasing cylinder and said first slave rephasing cylinder to retract and lower said monitor support; and switch means having a first position for activating said pump and said first valve means whereby said desk top is raised, a second position for activating said second valve means whereby said desk top is lowered, and a third position whereby said desk top is stopped, said switch means further having a fourth position for activating said pump and said third valve means whereby said monitor support is raised, a fifth position for activating said fourth valve means whereby said monitor support is lowered, and a sixth position whereby said monitor support is stopped;

whereby said desk top may be releveled by placing said switch means in its first position and raising said desk top until said first master rephasing cylinder and said first slave rephasing cylinder are fully extended; and whereby said monitor support may be releveled by placing said switch means in its fourth position and raising said monitor support until said second master rephasing cylinder and second slave rephasing cylinder are fully extended.

9. The desk of claim 8 further including means for preventing upward movement of said desk top with respect to said supporting structure except upon placement of said switch means in its first position.

10. The desk of claim 9 wherein said means for preventing upward movement of said desk top comprises a pilot operated check valve disposed in said fluid passageway means and responsive to the activation of said pump.

11. The desk of claim 8 further comprising means for preventing upward movement of said monitor support with respect to said supporting structure except upon placement of said switch means in its fourth position.

12. The desk of claim 11 wherein said means for preventing upward movement of said monitor support comprises a pilot operated check valve disposed in said fluid passageway means and responsive to the activation of said pump.

13. A hydraulic circuit for the height adjustment and releveling of a desk top comprising:

master and slave rephasing cylinders fluidly connected in series with one another and adapted to support and carry a desk top for vertical movement, each of said rephasing cylinders having a bypass port enabling fluid to pass through said cylinders when said cylinders are fully extended;

a supply of pressurized fluid;

fluid passageway means for interconnecting said supply and said master and slave rephasing cylinders in series;

first slave means in said fluid passageway means for selectively directing pressurized fluid into said master rephasing cylinder, thereby causing said master and slave rephasing cylinders to extend and raise the desk top;

second valve means in said fluid passageway means for selectively allowing fluid to exit said master and slave rephasing cylinders to return to said supply, thereby causing said master and slave rephasing cylinders to retract and lower said desk top; and switch means having a first state for activating said supply and said first valve means, whereby the top is raised, a second state for activating said second valve means whereby the top is lowered, and a third state wherein the top is stopped;

whereby said desk top may be releveled by actuating said switch means to the first state until said master cylinder and said slave cylinder are fully extended.

14. An improved article of furniture including a height-adjustable work surface and a hydraulic system for supporting, raising, and lowering said work surface, the improvement comprising said hydraulic system comprising:

a master rephasing cylinder and a slave rephasing cylinder connected fluidly in series with one another, said master and slave rephasing cylinders supporting separate portions of said work surface, said master and slave rephasing cylinders each having a bypass port enabling fluid to pass through said cylinders when said cylinders are fully extended;

supply means for supplying pressurized fluid;

fluid passageway means for interconnecting said supply means and said master rephasing cylinder and for interconnecting said master rephasing cylinder bypass port and said slave rephasing cylinder;

valve means in said fluid passageway means for selectively directing pressurized fluid into said master rephasing cylinder, thereby causing said master and slave rephasing cylinders to extend and raise said work surface, and for allowing fluid to exit said master and slave rephasing cylinders to return to said supply means, thereby causing said master and slave rephasing cylinder to retract and lower said work surface; and control means for controlling the operation of said valve means permitting selective extension, retraction, and rephasing of said master and slave rephasing cylinders, whereby said work surface can be releveled to any desired height by actuating said valve means until both of said master and slave rephasing cylinders are rephased and then actuating said valve means to retract said cylinders until said work surface is at the desired height.

* * * * *

UNITED STATES PATENT AND TRADEMARK OFFICE

CERTIFICATE OF CORRECTION

PATENT NO. : 5,320,047

DATED : June 14, 1994

INVENTOR(S) : John M. Deurloo and Roger L. Betten

It is certified that error appears in the above-indentified patent and that said Letters Patent is hereby corrected as shown below:

Column 9, Claim 1, Line 3:
"sleeve" should be --slave--

Column 9, Claim 4, Line 17:
"to" should be --top--

Column 10, Claim 8, Line 44:
"fast" should be --first--

Signed and Sealed this

Eighteenth Day of October, 1994

*Attest:*

Bruce Lehman

BRUCE LEHMAN

*Attesting Officer*

*Commissioner of Patents and Trademarks*